US005551458A

United States Patent [19]

Faxon

[11] Patent Number: 5,551,458

[45] **Date of Patent: * Sep. 3, 1996**

[54] PROCESS FOR CLEANING PIPE LINES

[76] Inventor: Johan Faxon, Ladugårdsvägen 36 B, S-269 38, Båstad, Sweden

[ * ] Notice: The portion of the term of this patent subsequent to Mar. 22, 2011, has been disclaimed.

[21] Appl. No.: 328,454

[22] Filed: Oct. 25, 1994

Related U.S. Application Data

[63] Continuation-in-part of PCT/SE94/00120 published as WO94/19118 Sep. 01, 1994.

[30] Foreign Application Priority Data

Feb. 26, 1993 [SE] Sweden ..... 9300645

[51] Int. Cl.[6] ..... B08B 9/00; B08B 9/02; B08B 9/04; B08B 5/02

[52] U.S. Cl. ..... 134/22.12; 134/22.18; 134/24; 134/23; 134/167 C; 134/172; 134/179

[58] Field of Search ..... 134/22.11, 22.12, 134/22.18, 24, 34, 167 C, 172, 179; 15/304, 394, 405

[56] References Cited

U.S. PATENT DOCUMENTS

| | | | |
|---|---|---|---|
| 1,587,194 | 6/1926 | Sladden | 134/167 C |
| 2,350,929 | 6/1944 | Ridley | 122/391 |
| 4,841,999 | 6/1989 | Danko | 134/22.1 |
| 5,003,998 | 4/1991 | Collett | 134/22.12 |
| 5,296,038 | 3/1994 | Faxon | 134/22.11 |

FOREIGN PATENT DOCUMENTS

| | | |
|---|---|---|
| 215405 | 9/1967 | Sweden . |
| WO91/13699 | 9/1991 | WIPO . |

*Primary Examiner*—Zeinab El-Arini
*Attorney, Agent, or Firm*—Watson Cole Stevens Davis, P.L.L.C.

[57] ABSTRACT

A process for cleaning pipelines and especially ventilation pipes and ducts in buildings, and includes a nozzle connected to a supply conduit through which a pressurized medium can flow. The arrangement includes a nozzle opening directed forward away from the supply conduit. The nozzle opening is in the form of a large continuous annular gap which extends along the periphery of the nozzle and is connected to the supply conduit and the source of a pressurized medium. The gap directs the medium toward the inner walls of the pipe or duct and effects a cleaning of the inner walls. The nozzle is moved into the pipe or duct by moving a rigid supply conduit.

4 Claims, 3 Drawing Sheets

Fig. 1.
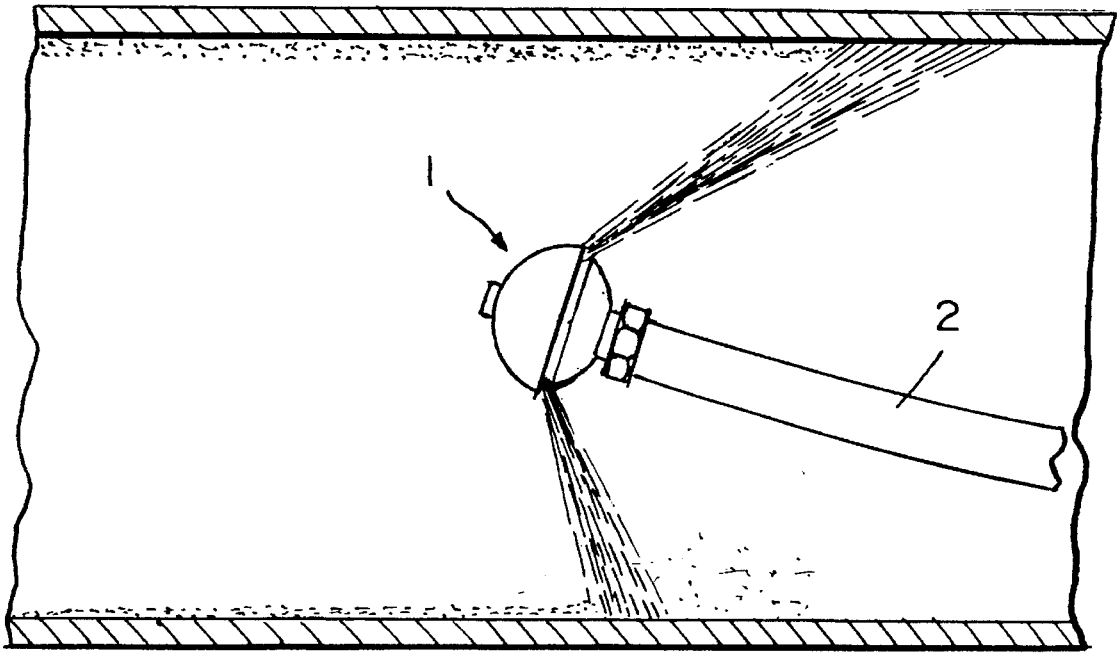
Fig. 2.
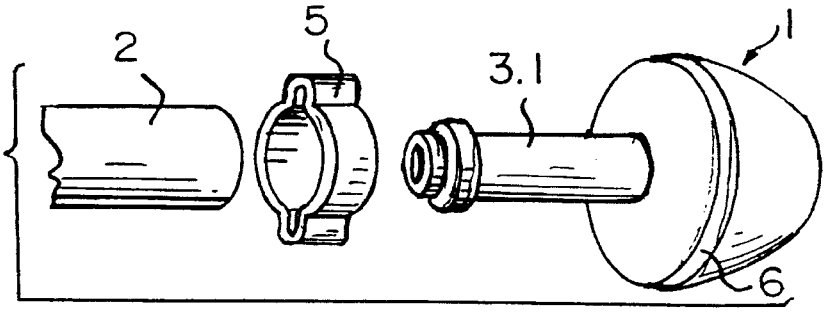
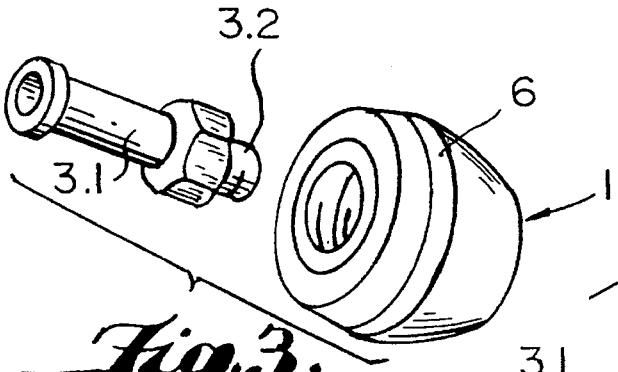
Fig. 3.
Fig. 4.
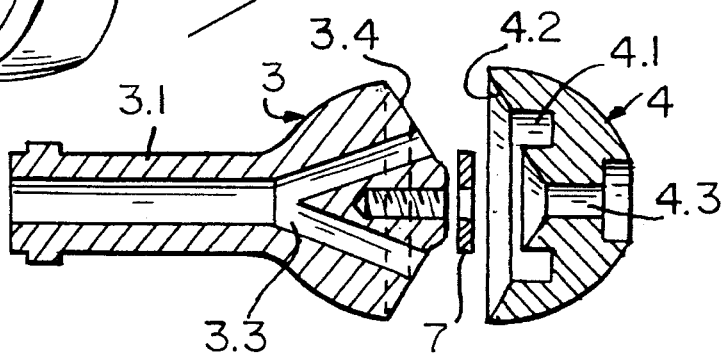

PROCESS FOR CLEANING PIPE LINES

CROSS-REFERENCE TO RELATED APPLICATION

This application is a continuation-in-part of PCT/SE94/00120, filed 15 Feb. 1994.

FIELD OF THE INVENTION

The present invention relates to a process and an apparatus for cleaning pipe lines, especially ventilation pipes and ventilation ducts in buildings, and comprises a cleaning means which is connected to a source of pressure medium, for example a compressed air compressor via a supply conduit, and which exhibits one or more nozzle openings which are directed at an acute angle to a center line which extends through the connection of the supply conduit in the cleaning means.

BACKGROUND OF THE INVENTION

The object of the present invention is to provide a cleaning arrangement according to the preamble, and which produces a satisfactory cleaning of pipe lines of loose dust, deposits and other contaminants plus disinfection of the lines. The invention primarily aims to provide cleaning of ventilation pipes and ventilation ducts, but being able to clean all types of conduits.

SUMMARY OF THE INVENTION

The above objectives are achieved by means of a process and a cleaning means according to the invention, the cleaning means being connected to a source of pressure medium via a supply conduit and exhibiting one or more nozzle openings which mainly are directed backwards towards and/or forward from the supply conduit. The above objectives are especially achieved by providing a nozzle opening in the form of a largely continuous annular gap which extends along the outermost periphery of the cleaning means and which is connected with the supply conduit and the source of pressure medium such that the medium is brought to flow out through the annular gap and clean the inner walls of the line. The cleaning means is brought in contact with the inner walls of the line as a consequence of the establishment of a reduced pressure between the cleaning means and the inner wall by the pressure medium which flows out between the cleaning means and the inner wall of the line. The process according to the invention is characterized in that the cleaning means is forced through the line by means of a driving means, and especially a rigid supply conduit. Preferably, the annular gap or the corresponding nozzle openings are directed forward in the driving direction of the cleaning means.

On cleaning of a pipe line a coupling arrangement is arranged on an inspection opening, exhaust valve, or the like, on one end of the pipe line and seals against the opening in the pipe line. The coupling arrangement is coupled by means of a conduit to a vacuum cleaner arrangement or the like, which is utilized to establish a reduced pressure in the pipe line. A cleaning means according to the invention, which is arranged in the one end of a rigid driving means or a rigid hose, is introduced preferably through another opening in the pipe line whereupon a pressure medium, for example compressed air or steam, is fed to the cleaning means, which preferably is forced into the pipe line by means of the rigid driving means. As a consequence of the high velocity of discharge of the outflowing medium and the above mentioned reduced pressure at the inner wall of the line, the cleaning means is brought in contact with the inner wall at the same time as the medium, and made to loosen dust, deposits and other contaminants from the inner wall. Thereafter, the dust or the deposits are sucked out by means of the vacuum cleaner arrangement.

It can be practical to conduct the cleaning in several steps, the first step consisting of making the cleaning means move through the pipe line during feeding of a solvent. In this step, the primary objective is not to loosen dust and remove deposits in the pipe line by means of the mechanical finishing ability of the air, but to feed a cleaning agent which contributes to the solubility of the deposits. The second step consists of making the cleaning means move through the pipe line under full pressure of the pressure medium, for example, forced by the introduction of the rigid supply conduit into the pipe line. The dust and the deposits are consequently released by means of the "cutting" action which is produced by the medium which discharges from the annular gap on the cleaning means, but possibly also as a consequence of any irregular movements and impacts of the cleaning means that may occur against the inner walls of the pipe line. The cleaning means is preferably caused to move in a rotating movement, for example, by turning the supply conduit cyclically a number of rotations first in one direction and thereafter in an equal number of turns in the opposite direction during the course of cleaning. When the cleaning means is introduced to a desired position in the pipe line, the supply of pressure medium is cut off whereafter the cleaning means is pulled out of the pipe line.

In an alternative embodiment of the invention, the cleaning means as a whole, or a sector of it, for example a front piece or a rear piece, is caused to rotate, for example, by turbine effect or forces of reaction from the pressure medium. As a result, the cleaning means is caused to rotate in permanent contact with the inner walls in a helical movement during the introduction in the pipe line.

On cleaning of ventilation pipes and ventilation ducts in buildings, the pressure medium is preferably utilized in the form of air which can be mixed with solvent or disinfectant in the different cleaning steps. Even steam can be utilized as pressure medium since the width of the annular gap in the cleaning means can be reduced and produces a smaller discharge from the annular gap compared with the case where compressed air is utilized. It is also within the scope of the invention to be able to combine the utilization of compressed air and steam since the solvent and disinfectant can be fed to the pipe line be means of compressed air while the actual cleaning is carried out by means of steam at high pressure, for example at 180 kp/cm$^2$.

Further features concerning the invention are evident from embodiments described below in connection with the accompanying drawings.

BRIEF DESCRIPTION OF THE DRAWINGS

The invention will be described in the following in the form of an embodiment in combination with the accompanying drawings.

FIG. 1 shows a cleaning arrangement according to the invention in operation in a pipe-shaped duct illustrated in a longitudinal section.

FIG. 2 shows a cleaning nozzle in the arrangement according to FIG. 1 which is adapted for coupling of a hose.

FIG. 3 shows an alternative design of the hose coupling according to FIG. 2.

FIG. 4 shows a longitudinal section through the cleaning nozzle according to FIG. 2, partly disassembled.

DETAILED DESCRIPTION OF THE INVENTION

Figure 5:
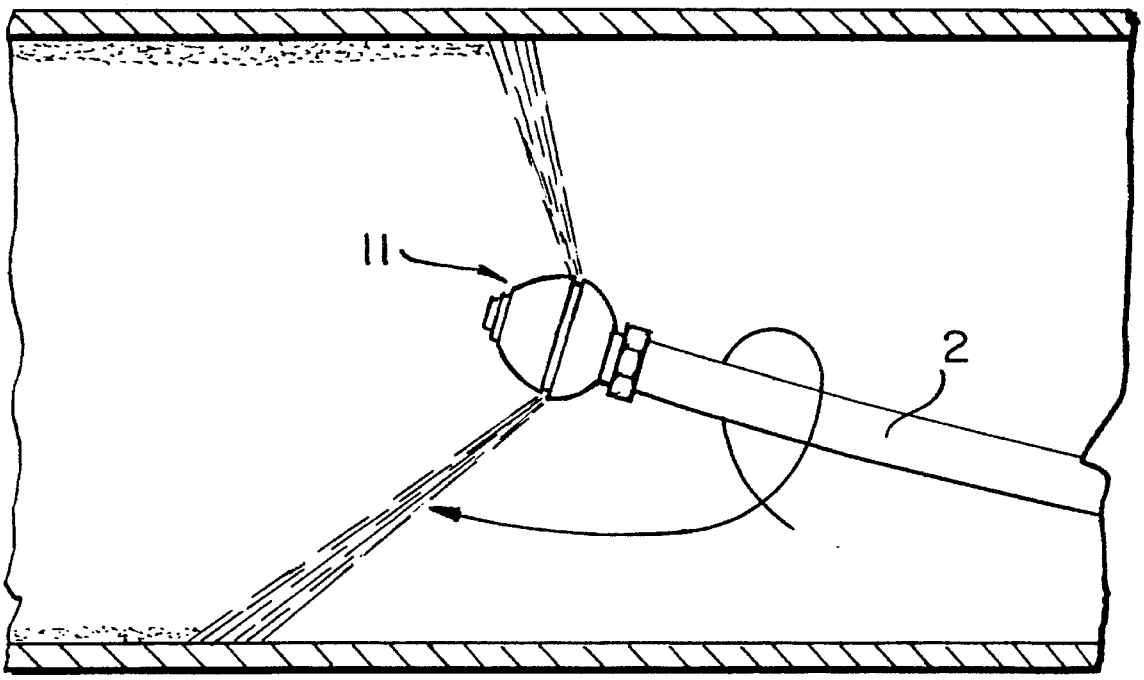
FIG. 5 shows a cleaning nozzle according to the invention in an alternative design, operating in a pipe-shaped duct in a longitudinal section.

The cleaning arrangement which is illustrated in FIGS. 1–4 comprises a cleaning nozzle 1, which is fixedly arranged in the end of a rigid hose 2 for feeding compressed air to the nozzle. The hose 2 is fastened on the cleaning nozzle 1 by means of a hose clamp 5. The parts are shown disassembled in FIG. 2. In FIG. 1 the cleaning arrangement is shown inserted in a pipe-shaped duct where dust and deposits are to be removed from the walls of the duct. The cleaning nozzle 1 includes a rear piece 3 and a front piece 4 dismantleable from this. The rear piece 3 is provided with a coupling pipe 3.1 to which the hose 2 is secured by means of a hose clamp 5. The coupling pipe 3.1 can constitute an integrated portion of the rear piece 3, such as is shown for example in FIGS. 2 and 4, or it can be secured with a threaded pin 3.2 such as is shown in FIG. 3. The rear piece 3 exhibits four distribution holes 3.3 which are arranged symmetrically about its central axis, which is evident from FIG. 4, and the holes 3.3 are connected to the coupling pipe 3.1 and discharge into the forward end of the rear piece directed towards the front piece 4. The front piece 4, which largely has the shape of a hemisphere, shows a mixing chamber 4.1 which extends symmetrically about its central axis and with the same radius as for which the distribution holes 3.3 are arranged around the axis. The rear piece 3 furthermore presents an external conical surface 3.4 which extends along its periphery at its front end, and which corresponds to an internal conical surface 4.2 on the front piece, the assembled cleaning nozzle 1 exhibiting an annular gap 6 along the periphery of the nozzle which is directed back out towards the coupling piece 3.1. The width of the annular gap 6 can be regulated by means of a washer 7, the thickness of which determines the width of the gap so that a thicker washer 7 gives a wider annular gap 6. The front piece 4 is fixedly mounted on the rear piece 3 by means of a screw 8 which passes through a central hole 4.3 in the front piece 4 and is screwed into a threaded hole in the rear piece 3.

In this design of a cleaning arrangement the cleaning nozzle 1 is brought forward through the duct by forces of reaction from the outflowing pressure medium which flows in an angle backwards in the movement direction. Here, the rigid hose 2 is utilized to influence and control the position of the cleaning nozzle in the duct. In this design the cleaning nozzle 1 also can be provided with a rotatable mounted front piece 4 through which the entire cleaning nozzle 1 can be caused to rotate laterally during introduction in the duct concerned.

Herein, the definition of "pressurized medium" includes: compressed air; compressed air mixed with solvent; compressed air mixed with disinfectant; compressed air mixed with cleaning agent; compressed air mixed with cleaning agent and disinfectant; compressed air mixed with steam; compressed air mixed with steam, solvent and disinfectant; and steam.

Figure 6:
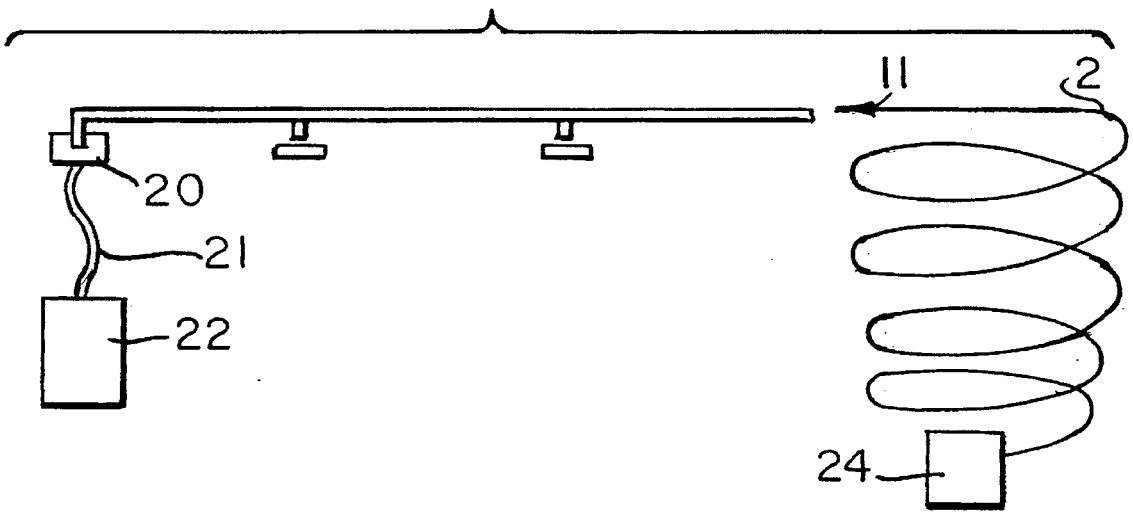
FIG. 6 schematically shows the utilization of the cleaning arrangement according to FIG. 5 during the cleaning of a ventilation duct.

The cleaning arrangement which is shown in FIG. 5 and FIG. 6 operates, as opposed to the cleaning arrangement described above, with a pressure medium which is caused to flow out forward in the driving direction of the cleaning arrangement, from a cleaning nozzle 11 according to an alternative design. Here, the cleaning nozzle 11 is forced into the duct by means of the rigid hose 2 against the force from the outflowing pressure medium. In this case even the cleaning nozzles 11 are utilized together with both fixed and rotating front pieces.

Figure 7:
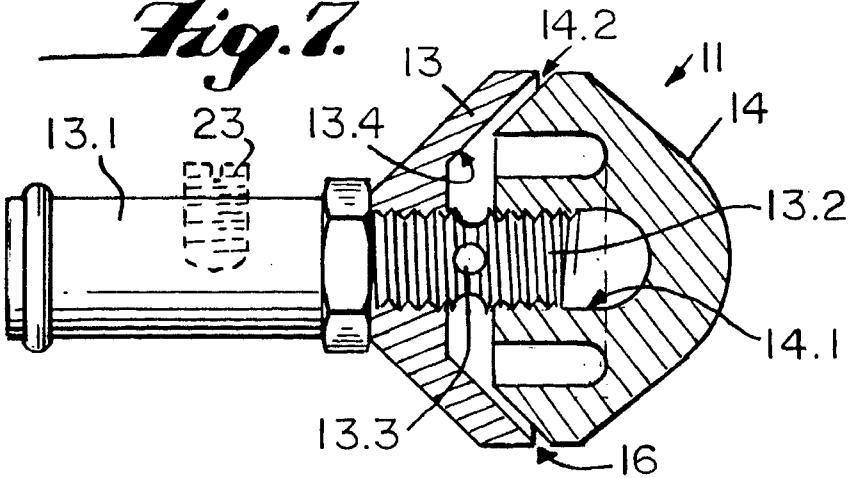
FIG. 7 shows the cleaning nozzle according to FIG. 5 in a first alternative design in a longitudinal section.

In a first design of such a cleaning nozzle 11, which is shown in FIG. 7, the design includes a front piece 14, fixedly mounted on the rear piece 13, showing an internal threading 14.1. The rear piece is provided with a coupling pipe 13.1 for the hose on which the cleaning nozzle 11 is to be arranged, and which shows an externally threaded pipe section 13.2 which protrudes through the rear piece 13 and into the front piece 14. The pipe-section 13.2 shows distribution holes 13.3 for the supply of pressure medium equally divided along the periphery of the section. The rear piece 13 furthermore shows an internal conical surface 13.4 which corresponds to an external conical surface 14.2 on the front piece 14, the assembled cleaning nozzle 1 exhibiting an annular gap 16 directed forward towards its tip. The width of the annular gap 16 can be regulated by turning the front piece 14 relative to the rear piece 13.

Figure 10:
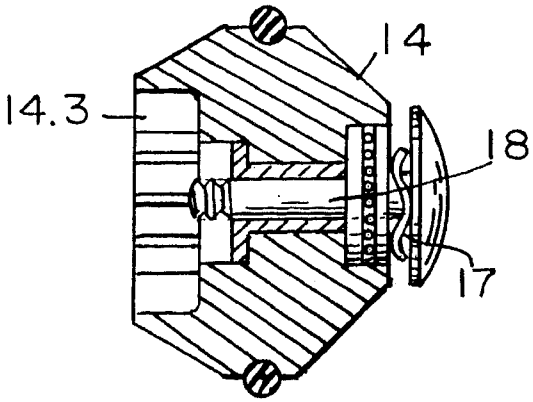
FIG. 10 shows a detail of the cleaning nozzle according to FIG. 8.
Figure 9:
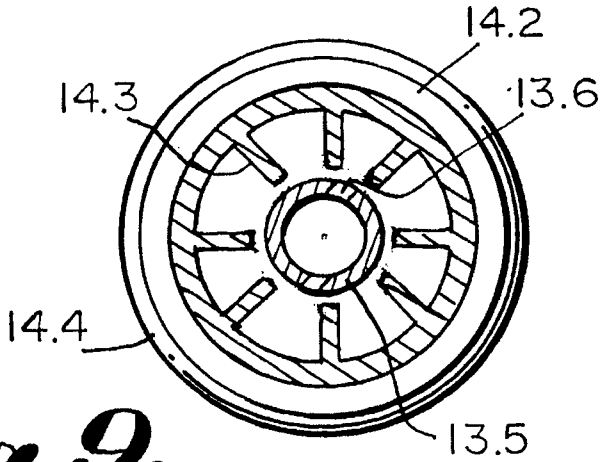
FIG. 9 shows a transverse section of the cleaning nozzle according to FIG. 8 along line A—A.
Figure 8:
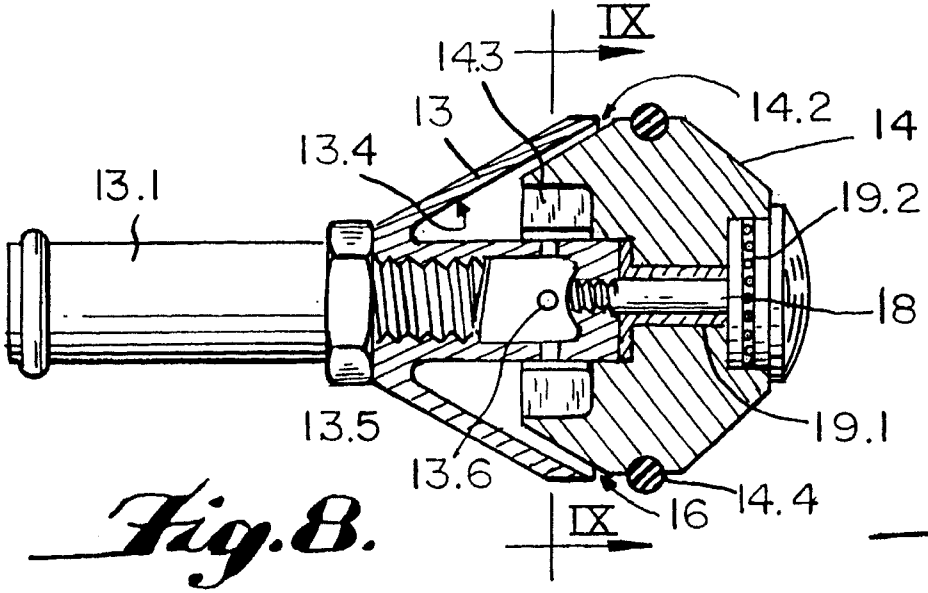
FIG. 8 shows the cleaning nozzle according to FIG. 5 in a second alternative design in a longitudinal section.

In a second alternative design of such a cleaning nozzle 11, which shown in FIG. 8 and FIG. 9, the front piece 14 is rotatably mounted on the rear piece 13. In this design the rear piece 13 and the front piece 14 show the same conical surfaces 13.4, 14.2 and annular gap 16 as in the first alternative design of the cleaning nozzle 11, but differ in that the front piece 14 in this design is rotatable. In this design the rear piece 13 shows a pipe-shaped section 13.5 which is showing a closing gable into which a stubaxle provided with a head 18 is screwed. The front piece 14 is rotatable around the stubaxle 18 in a radial bearing 19.1 and steadies against a thrust bearing 19.2 arranged at the front section of the front piece 14. A spring washer 17 is arranged between the thrust bearing 19.2 and the head of the stubaxle 18 as shown in FIG. 10. The spring washer 17 keeps the front piece 14 pressed against the rear piece 13 until the pressure in the nozzle has reached a level overcoming the spring force. In this way the increased pressure contributes to increase the rigidity in the hose 2 at the same time as the pressure medium is caused to flow out through the annular gap 16 not until this has reached a level which provides the desired contact to the inner wall of the duct and the desired cleaning capacity. The pipe-shaped section 13.5 on the rear piece 13 presents tangentially directed outlet openings 13.6, from which the pressure medium is caused to flow out in high velocity, acting on turbine blades 14.3, which are arranged in a groove in the front piece 14 which encloses the pipe section 13.5 on the rear piece 13. The front piece 14 carries also a friction ring 14.4 which extends along the outermost periphery of the front piece 14. This friction ring 14.4 can even be completed with or replaced by a ring-shaped brush, not shown in the figures, by means of which even a mechanical working on dirt and deposits is carried out.

On cleaning of a pipe-shaped ventilation duct such as is shown in FIG. 6, an exhaust valve for example is replaced with a coupling arrangement 20 for a suction hose 21 belonging to a vacuum cleaner arrangement 22. During the cleaning operation, the cleaning nozzle 11, after insertion in the ventilation duct which, is to be cleaned, is fed with compressed air from a compressed-air-unit 24 which if desired, is fed with a cleaning agent and/or a disinfectant. At high velocity, compressed air consequently discharges forward from the annular gap 16 along the periphery of the cleaning nozzle 11 at the same time as the nozzle 11 is forced into the duct, against the forces of reaction from the discharging air, by means of the rigid hose 2. Simultaneously, the suction hose 21 is placed under reduced pressure so that dust which is released from the inner walls of the duct is sucked away from the duct and is collected in the vacuum cleaner arrangement 22.

It also lies within the scope of the invention to be able to combine an annular gap 6 pointing backwards and an annular gap 16 directed forward in one and the same cleaning nozzle and to feed the pressure medium by either just one common supply conduit 2 or a supply conduit which shows at least two ducts for the pressure medium. The supply conduit also can consist of special ducts for the supply of other media as for example cleaning agents. By directing the pressure medium towards the two annular gaps 6, 16 the possibility is attained to balance the forces of reaction from the annular gaps 6, 16 and accordingly to direct the more or less forced motion of the cleaning nozzle.

The pressure of the medium in the supply conduit is depending among others also of the outlet area of the annular gap or gaps. To adjust this pressure in order to impart a desired rigidity to the supply conduit 2, as this is constituted by a relatively soft hose, a restricting means 23 can be arranged on the rear piece 13 or on its pipe-shaped coupling piece 13.1 for the supply conduit 2. Such a restricting means is shown in FIG. 7 in the shape of a restricting screw 23 arranged in a threaded hole in the coupling piece 13.1, which will restrict the flow of the medium in the supply conduit 2 as it is screwed into the coupling piece 13.1 encreasing the pressure in the supply conduit 2. Depending on the design of the rear piece 13 and its coupling piece 13.1 the restricting screw 23 can be arranged in many different positions. Instead of a restricting screw 23 a restricting valve can be arranged and even separately at the end of the supply conduit 2.

I claim:

1. A process for cleaning pipe lines with a cleaning means, which is connected via a rigid supply conduit to a source of pressurized medium and which exhibits nozzle opening directed in at least one direction of a backward direction and a forward direction, said backward direction being a direction towards said supply conduit and said forward direction being a direction away from said supply conduit, wherein said nozzle opening is in a form of a substantially continuous annular gap which extends along a periphery of the cleaning means and which is connected to the supply conduit and the source of pressurized medium, said process comprising the steps of:

discharging said pressurized medium through the nozzle opening to clean inner walls of a pipeline;

bringing said nozzle opening in close contact with the inner wall of the pipeline to cause a pressure differential on opposite sides of the cleaning means thereby keeping the cleaning means in contact with the inner wall; and forcing the cleaning means forward through the pipeline by means of moving said rigid supply conduit therethrough, wherein the discharging pressurized medium is at least directed forward in the direction of movement of the cleaning means.

2. A process as defined in claim 1, wherein the supply conduit comprises a hose made rigid by carrying said pressurized medium therethrough and restricting a discharge of pressurized medium from said nozzle opening.

3. A process for cleaning pipelines with a cleaning means having a longitudinal axis and which is connected via a rigid supply conduit to a source of pressurized medium, wherein the cleaning means has at least one nozzle opening which is directed forward away from the supply conduit at an angle relative to a center line which extends through a fastening of the supply conduit to the cleaning means, and wherein the nozzle opening is in the form of a substantially continuous annular gap which extends along a periphery of the cleaning means and which is connected to the supply conduit and the source of pressurized medium, the pressurized medium being made to discharge through the annular gap and partly clean inner walls of a pipeline, said process including the steps of bringing the cleaning means into contact with an inner wall of a pipeline, discharging pressurized medium from said source and supply conduit through said nozzle opening; and moving the cleaning means and supply conduit through the pipeline to clean the inner wall thereof.

4. A process according to claim 3, wherein said supply conduit is made rigid by restricting the discharge of pressurized medium from said supply conduit through said nozzle opening such that a pressure caused by said pressurized medium imparts rigidity to said supply conduit.

* * * * *